US009623580B2

(12) United States Patent
Nakamura

(10) Patent No.: US 9,623,580 B2
(45) Date of Patent: Apr. 18, 2017

(54) RECORDING MATERIAL POST-PROCESSING DEVICE AND IMAGE FORMING SYSTEM

(71) Applicant: FUJI XEROX CO., LTD., Tokyo (JP)

(72) Inventor: Yasuo Nakamura, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 582 days.

(21) Appl. No.: 13/796,174

(22) Filed: Mar. 12, 2013

(65) Prior Publication Data

US 2014/0060276 A1 Mar. 6, 2014

(30) Foreign Application Priority Data

Aug. 31, 2012 (JP) ..... 2012-191356

(51) Int. Cl.
*B65H 33/04* (2006.01)
*B26D 5/06* (2006.01)
(Continued)

(52) U.S. Cl.
CPC ..... *B26D 5/06* (2013.01); *B26D 5/02* (2013.01); *B26D 7/015* (2013.01); *B26F 1/0092* (2013.01); *Y10T 83/538* (2015.04)

(58) Field of Classification Search
CPC B26D 5/06; B26D 5/02; B26F 1/0092; Y10T 83/538
(Continued)

(56) References Cited

U.S. PATENT DOCUMENTS 6,027,107 A * 2/2000 Natsume et al. ..... 270/37
6,361,036 B1 * 3/2002 Nakazawa ..... 270/58.07
(Continued)

FOREIGN PATENT DOCUMENTS

CN 101274722 A 10/2008
JP 2005-274772 A 10/2005
(Continued)

OTHER PUBLICATIONS

Mar. 23, 2016 Office Action issued in Chinese Application No. 201310127322.8.
(Continued)

*Primary Examiner* — Omar Flores Sanchez
(74) *Attorney, Agent, or Firm* — Oliff PLC

(57) ABSTRACT

A recording material post-processing device includes: a recording material receiving unit that receives a recording material on which an image is formed from an image forming apparatus, the apparatus including an image forming unit that forms an image on a recording material to be transported, and a detection unit that detects a position of the recording material, on which the image is to be formed by the image forming unit, in a direction intersecting a transport direction of the recording material; a post-processing unit that performs post processing on the recording material received via the recording material receiving unit from the image forming apparatus; and a moving unit that moves the post-processing unit in the direction intersecting the transport direction of the recording material based on information related to the position of the recording material detected by the detection unit of the image forming apparatus.

4 Claims, 8 Drawing Sheets

(51) Int. Cl.
*B26D 5/02* (2006.01)
*B26D 7/01* (2006.01)
*B26F 1/00* (2006.01)

(58) Field of Classification Search
USPC ..... 83/368, 370, 156, 426
See application file for complete search history.

(56) References Cited

U.S. PATENT DOCUMENTS

| | | | | |
|---|---|---|---|---|
| 6,755,410 | B2 * | 6/2004 | Kaneko | 270/32 |
| 6,928,259 | B2 * | 8/2005 | Sakuma | 399/407 |
| 6,988,729 | B2 * | 1/2006 | Tamura et al. | 271/303 |
| 7,333,767 | B2 * | 2/2008 | Kaneko et al. | 399/407 |
| 2002/0060388 | A1 * | 5/2002 | Wakabayashi et al. | 270/58.08 |
| 2002/0079640 | A1 * | 6/2002 | Yoshie et al. | 271/176 |
| 2003/0057641 | A1 * | 3/2003 | Yamada et al. | 271/298 |
| 2005/0271445 | A1 | 12/2005 | Hanada et al. | |
| 2008/0018040 | A1 | 1/2008 | Tamura et al. | |
| 2008/0237965 | A1 | 10/2008 | Moriyama et al. | |
| 2008/0308988 | A1 | 12/2008 | Iguchi et al. | |
| 2009/0243180 | A1 | 10/2009 | Moriyama et al. | |

FOREIGN PATENT DOCUMENTS

| | | | |
|---|---|---|---|
| JP | A-2006-240790 | | 9/2006 |
| JP | 2006-273543 | A | 10/2006 |
| JP | 2007-055748 | A | 3/2007 |
| JP | 3946064 | B2 | 7/2007 |
| JP | 2008-024445 | A | 2/2008 |
| JP | 2008-037648 | A | 2/2008 |

OTHER PUBLICATIONS

Mar. 8, 2016 Office Action issued in Japanese Application No. 2012-191356.

* cited by examiner

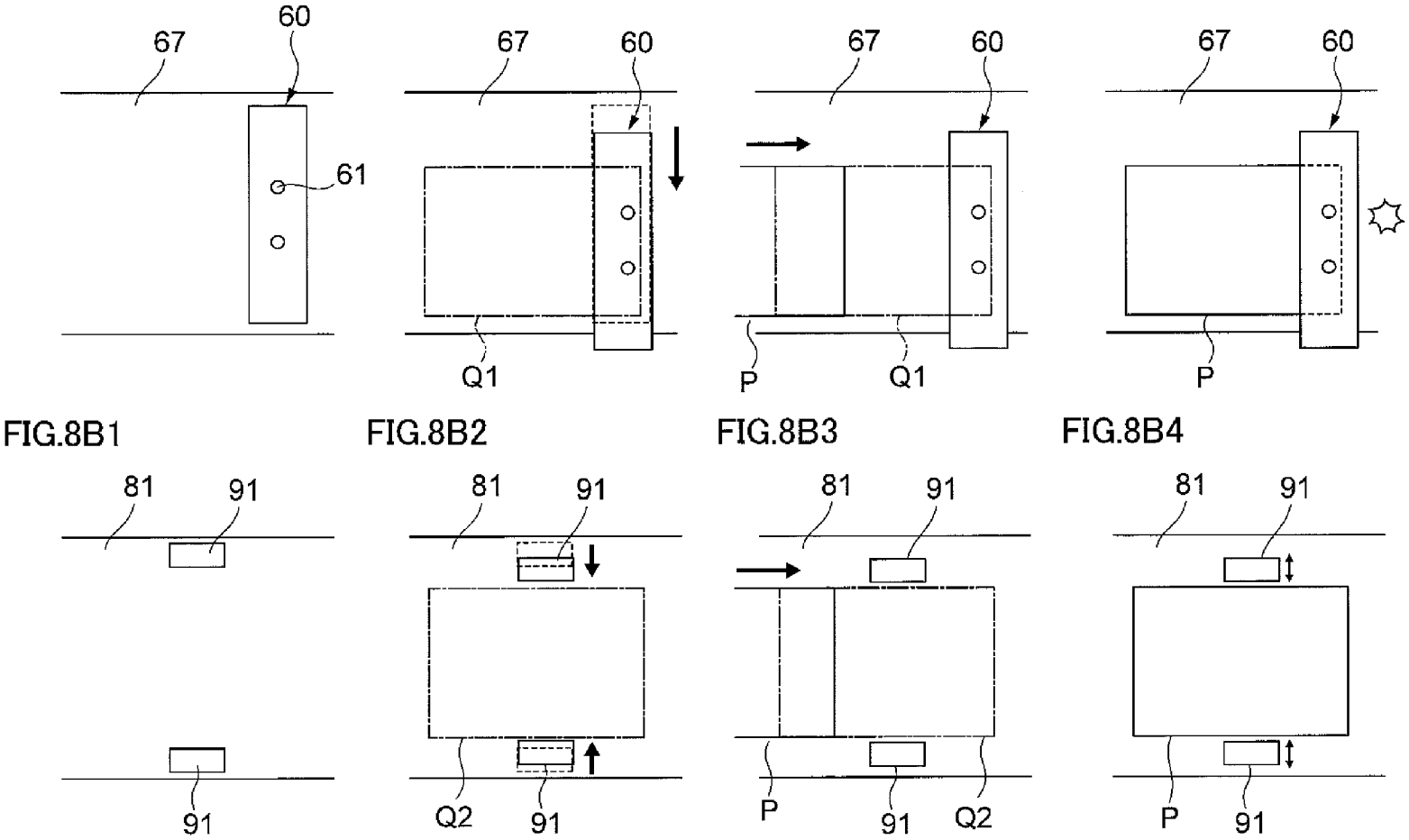
FIG.8A1
60
61
67
FIG.8A2
60
67
Q1
FIG.8A3
60
67
Q1
P
FIG.8A4
60
67
P
FIG.8B1
81
91
91
FIG.8B2
81
91
91
Q2
FIG.8B3
81
91
91
Q2
P
FIG.8B4
81
91
91
P

RECORDING MATERIAL POST-PROCESSING DEVICE AND IMAGE FORMING SYSTEM

CROSS REFERENCE TO RELATED APPLICATIONS

This application is based on and claims priority under 35 USC §119 from Japanese Patent Application No. 2012-191356 filed Aug. 31, 2012.

BACKGROUND

Technical Field

The present invention relates to a recording material post-processing device and an image forming system.

Related Art

As a conventional art, there is known a post-processing device provided with a punching unit that receives a sheet transported from an image forming apparatus and punches holes in the sheet.

SUMMARY

According to an aspect of the present invention, there is provided a recording material post-processing device including: a recording material receiving unit that receives a recording material on which an image is formed from an image forming apparatus, the apparatus including an image forming unit that forms an image on a recording material to be transported, and a detection unit that detects a position of the recording material, on which the image is to be formed by the image forming unit, in a direction intersecting a transport direction of the recording material; a post-processing unit that performs post processing on the recording material received via the recording material receiving unit from the image forming apparatus; and a moving unit that moves the post-processing unit in the direction intersecting the transport direction of the recording material based on information related to the position of the recording material detected by the detection unit of the image forming apparatus.

BRIEF DESCRIPTION OF THE DRAWINGS

An exemplary embodiment of the present invention will be described in detail based on the following figures, wherein:

FIGS. 8A1 to 8A4 and 8B1 to 8B4 are diagrams for illustrating movement of a punching unit and dampers in accordance with positional information of a sheet.

DETAILED DESCRIPTION

An exemplary embodiment of the present invention will be described in detail with reference to the attached drawings.

Figure 1:
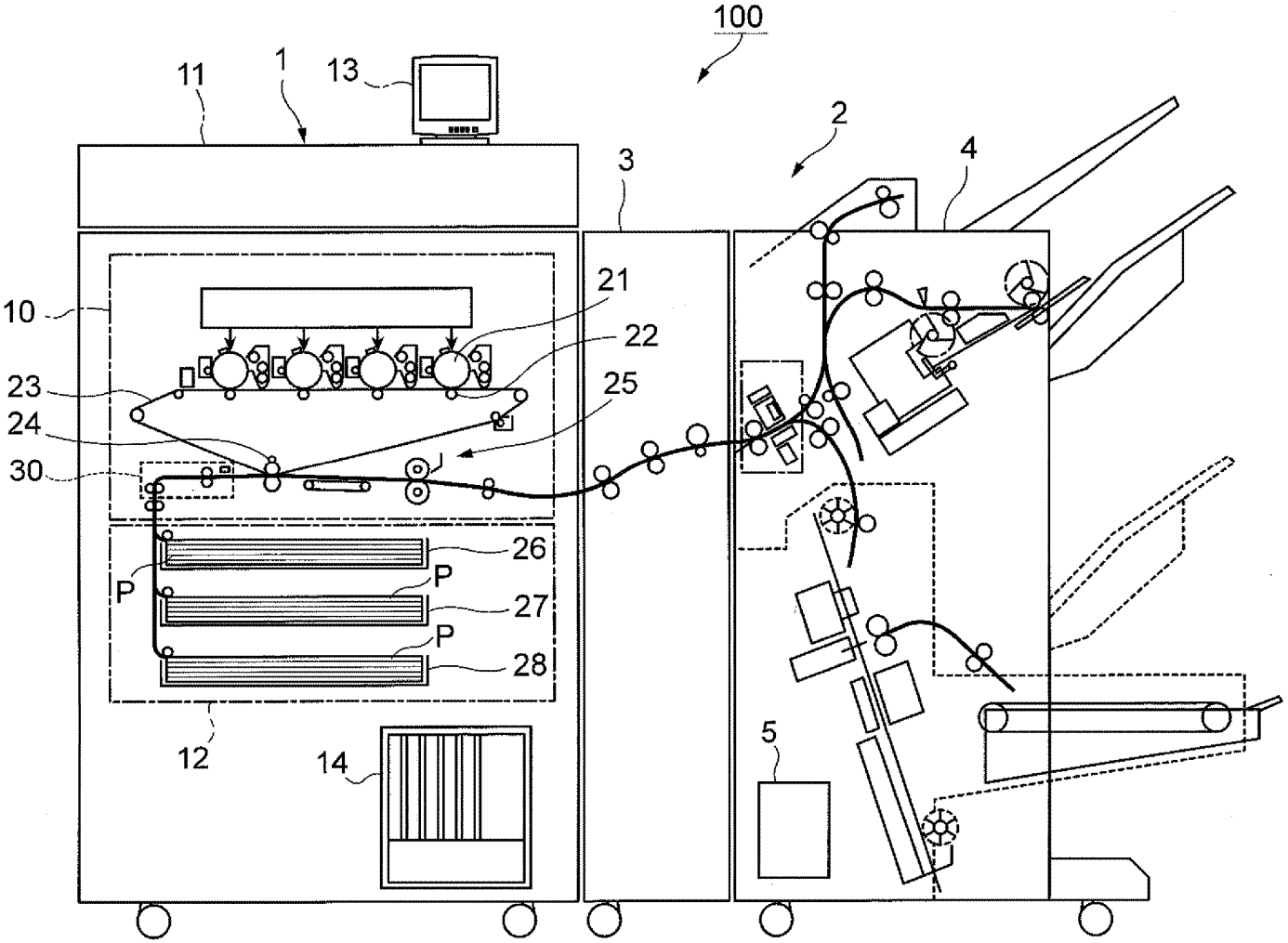
FIG. 1 is a diagram showing an entire configuration of an image forming system to which the exemplary embodiment is applied.

FIG. 1 is a diagram showing an entire configuration of an image forming system 100 to which the exemplary embodiment is applied. The image forming system shown in FIG. 1 includes an image forming apparatus 1 that forms an image on, for example, a sheet, and a post-processing device 2, which is an example of a recording material post-processing device, that performs post processing on a recording material on which an image has been formed by the image forming apparatus 1.

The image forming apparatus 1 employs a so-called tandem type, and includes: an image forming unit 10, which is an example of an image forming unit, that forms an image based on each color image data; an image reader 11 that reads an image from an original and forms read image data to be used in forming an image in the image forming unit 10; a sheet supply unit 12 that has plural (in this specific example, three) sheet trays 26 to 28 for containing sheets P and supplies the sheets P to the image forming unit 10; an operation input unit 13 that receives operation input from a user; and a main controller 14 that controls operations of the image forming apparatus 1 and operations of the entire image forming system 100.

The post-processing device 2 includes: a transport unit 3 that receives and transports a sheet P on which an image has been formed by the image forming apparatus 1; a finisher unit 4 that performs processes, such as punching, end stitching and saddle stitching, on the sheet P transported from the transport unit 3 or a bundle of sheets that collects plural sheets P; and a sheet processing controller 5 that controls each functional unit in the post-processing device 2. It should be noted that, in the post-processing device 2 as shown in FIG. 1, there is shown the configuration in which the sheet processing controller 5 is provided in the post-processing device 2; however, the sheet processing controller 5 may be provided in the image forming apparatus 1. In addition, the function of the main controller 14 in the image forming apparatus 1 that controls operations of the entire image forming system 100 may also serve as the controlling function of the sheet processing controller 5.

It should be noted that each of the main controller 14 and the sheet processing controller 5 includes: a central processing unit (CPU) that executes various kinds of computations; a read only memory (ROM) that stores programs to be executed by the CPU, various kinds of data and the like; and a random access memory (RAM) to be used as a working memory of the CPU.

<Description of Image Forming Apparatus>

Subsequently, the image forming unit 10 of the image forming apparatus 1 will be described.

The image forming unit 10 of the exemplary embodiment includes: four photoconductive drums 21 that correspond to respective colors of black (K), yellow (Y), magenta (M) and cyan (C), and are arranged in parallel in the horizontal direction; four primary transfer rolls 22 that are provided corresponding to the respective photoconductive drums 21; an intermediate transfer belt 23 onto which toner images formed on the respective photoconductive drums 21 are primarily transferred sequentially; a secondary transfer roll 24 that performs secondary transfer of the toner images having been primarily transferred to the intermediate transfer belt 23 onto a sheet P; and a fixing device 25 that fixes the toner images on the sheet P that has been subjected to the secondary transfer.

The image forming unit 10 of the exemplary embodiment also includes an attitude correction unit 30 that corrects attitude of the sheet P transported toward the secondary transfer roll 24. The configuration of the attitude correction unit 10 will be described later.

Here, around each of the photoconductive drums 21, there are arranged a charging device that charges the surface of the photoconductive drum 21, a laser writing device that forms an electrostatic latent image by laser irradiation on the surface of the photoconductive drum 21 charged by the charging device, a developing device that visualizes the electrostatic latent image formed on the photoconductive drum 21 with toner of each color, a cleaner that removes residual toner remaining on the photoconductive drum 21 after primary transfer and so on.

In contrast, each of the primary transfer rolls 22 is arranged to face each corresponding photoconductive drum 21 with the intermediate transfer belt 23 interposed therebetween. These primary transfer rolls 22 perform primary transfer of the toner images formed on the corresponding photoconductive drums onto the intermediate transfer belt 23. The intermediate transfer belt 23 is provided with tension by plural support rolls like a loop.

The secondary transfer roll 24 is provided to face the intermediate transfer belt 23. The secondary transfer roll 24 performs secondary transfer (collective transfer) of the toner images in respective colors that have been primarily transferred to the intermediate transfer belt 23 sequentially onto a sheet.

The fixing device 25 fixes the toner image to the sheet by heating and pressurizing.

In the image forming unit 10, a sheet P is supplied from the attitude correction unit 30 to the secondary transfer roll 24 on timing of transporting the toner images of respective colors on the intermediate transfer belt 23 to the position where the secondary transfer roll 24 is arranged. Accordingly, the toner images of respective colors are electrostatically transferred onto the sheet P collectively by the action of a transfer electric field generated by the secondary transfer roll 24.

Thereafter, the sheet P onto which the toner images of respective colors are secondarily transferred is peeled from the intermediate transfer belt 23 and transported to the fixing device 25. In the fixing device 25, the toner images of respective colors are fixed to the sheet P by the fixing process using heat and pressure to form a color image on the sheet P. Then, the sheet P on which the color image is formed is outputted from the image forming apparatus 1, and transported into the post-processing device 2 that is connected to the image forming apparatus 1.

<Description of Attitude Correction Unit>

Subsequently, the attitude correction unit 30 will be described.

Figure 2:
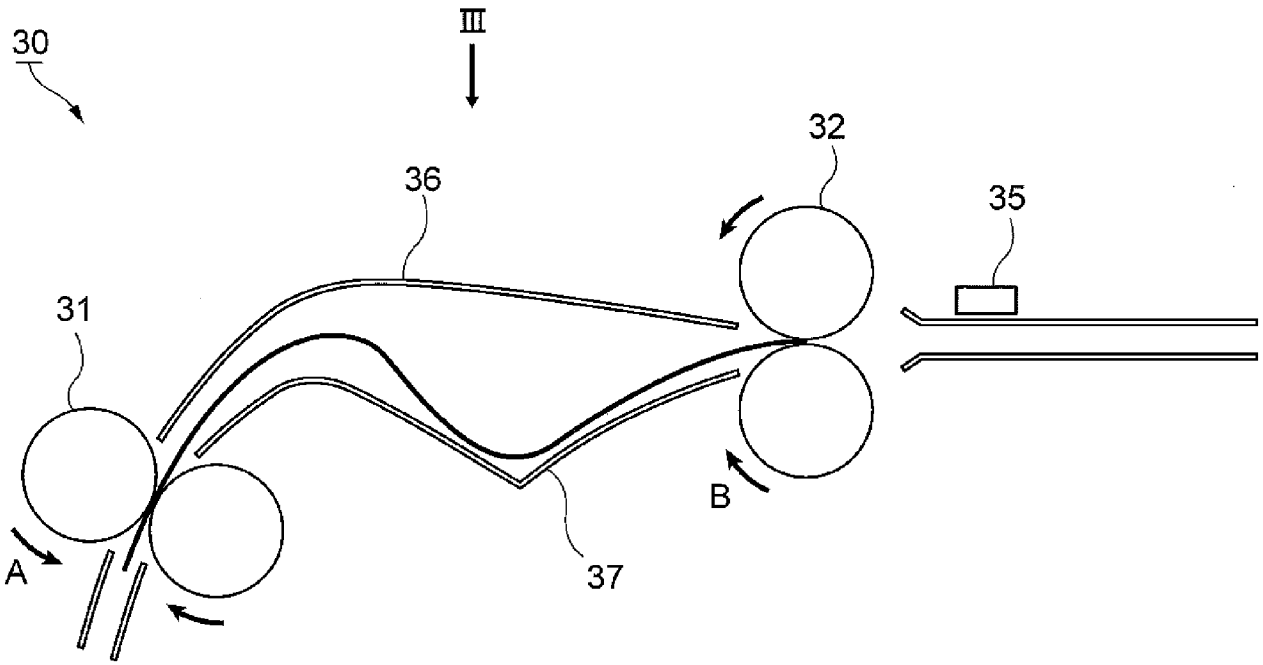
FIG. 2 is a diagram showing a configuration of an attitude correction unit of the exemplary embodiment.

FIG. 2 is a diagram showing a configuration of the attitude correction unit 30 of the exemplary embodiment. FIGS. 3A to 3D are diagrams for illustrating the attitude correction method for a sheet P executed by the attitude correction unit 30 of the exemplary embodiment, in which the attitude correction unit 30 is viewed from the direction III in FIG. 2.

As shown in FIG. 2, the attitude correction unit 30 of the exemplary embodiment includes a pair of registration rolls 32, which is an example of a correction unit, for transporting the sheet P toward the secondary transfer roll 24 (refer to FIG. 1), that is configured with a pair of rolls in contact with each other with pressure, and a pair of upstream side transport rolls 31, which is configured with a pair of rolls in contact with each other with pressure and is provided on an upstream side of the pair of registration rolls 32 in the transport direction of the sheet P to transport the sheet P toward the pair of registration rolls 32.

Further, the attitude correction unit 30 includes a detection sensor 35, which is an example of a detection unit, that is provided on a downstream side of the pair of registration rolls 32 in the sheet transport direction to detect a position in the width direction, which is orthogonal to the transport direction, of the sheet P transported by the pair of registration rolls 32. Still further, the attitude correction unit 30 includes an upper guide member 36 and a lower guide member 37 for guiding transport of the sheet P transported by the pair of upstream side transport rolls 31 and the pair of registration rolls 32.

The pair of upstream side transport rolls 31 is rotated in the direction of arrow A by a not-shown driving motor. In addition, the pair of upstream side transport rolls 31 is configured so that nip between the facing rolls is able to be released by a not-shown driving motor.

The pair of registration rolls 32 is configured to be rotated in the direction of arrow B by a not-shown driving motor and to be movable in the direction of the rotational axis.

The detection sensor 35 is, for example, as shown in FIGS. 3A to 3D, configured with a line sensor or the like, which is provided to extend in a direction orthogonal to the transport direction of the sheet P. The detection sensor 35 detects the position of the sheet P transported by the pair of registration rolls 32, the position being orthogonal to the transport direction of the sheet P, and outputs the detection result to the main controller 14. The detection sensor 35 is not limited to the line sensor as long as the sensor is able to detect the position of the sheet P orthogonal to the transport direction.

It should be noted that, in the following description, the direction orthogonal to the transport direction of the sheet P will be referred to as a width direction of the sheet P in some cases.

Subsequently, description will be given to the attitude correction process for the sheet P performed by the attitude correction unit 30 of the exemplary embodiment. In this specific example, description will be given to the case where the sheet P is transported to the attitude correction unit 30 in a skewed state with respect to the transport direction.

Figure 3A:
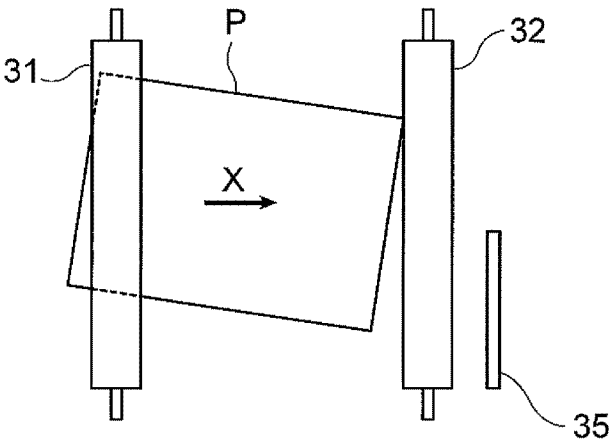
FIGS. 3A to 3D are diagrams for illustrating an attitude correction method for a sheet executed by the attitude correction unit of the exemplary embodiment.

When the sheet P is transported from the sheet supply unit 12 (refer to FIG. 1) to the attitude correction unit 30, first, the pair of upstream side transport rolls 31 is rotated by the driving motor on predetermined timing. It should be noted that the pair of registration rolls 32 is not rotated at the time when rotation of the pair of upstream side transport rolls 31 is started. Then, as shown in FIG. 3A, the sheet P is transported in the direction of arrow X by the rotation of the pair of upstream side transport rolls 31, and a leading edge side of the sheet P in the transport direction contacts the pair of registration rolls 32. In this specific example, since the sheet P is transported in a skewed state with respect to the sheet transport direction, part of one end portion in the width direction of the sheet P first contacts the pair of registration rolls 32, but the other end portion in the width direction of the sheet P does not contact the pair of registration rolls 32 as shown in FIG. 3A.

After the part of the one end portion in the width direction of the sheet P contacts the pair of registration rolls 32, the pair of upstream side transport rolls 31 is continuously rotated in the state where the rotation of the pair of registration rolls 32 is stopped. Consequently, on the leading edge side of the sheet P in the transport direction, transport is stopped in the state where the part of the leading edge of the sheet P is in contact with the pair of registration rolls 32. On the other hand, on a trailing edge side of the sheet P in the transport direction, transport of the sheet P in the direction of arrow X is continuously performed by the rotating pair of upstream side transport rolls 31.

Figure 3B:
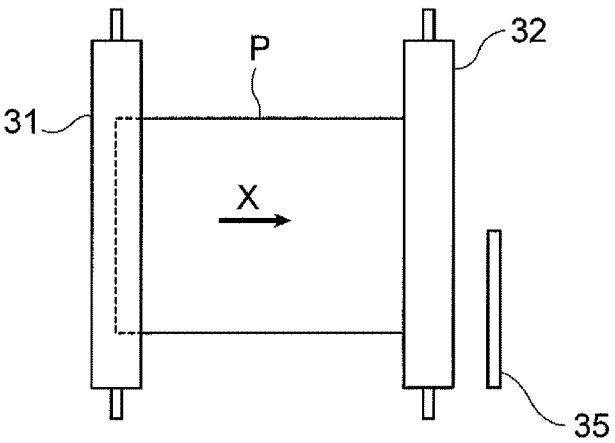

In association with this, as shown in FIG. 2, bending is formed on the leading edge side of the sheet P in the transport direction. Further, on the leading edge side of the sheet P in the transport direction, a force to restore the bending by stiffness of the sheet P itself is exerted. Consequently, on the leading edge side of the sheet P in the transport direction, the other end portion in the width direction of the sheet P that has not contact the pair of registration rolls 32 is brought into contact with the pair of registration rolls 32. Then, as shown in FIG. 3B, on the leading edge side of the sheet P in the transport direction, all over the width direction from the one end portion to the other end portion comes to the state in contact with the pair of registration rolls 32, and thereby skewing of the sheet P with respect to the transport direction is corrected.

Figure 3C:
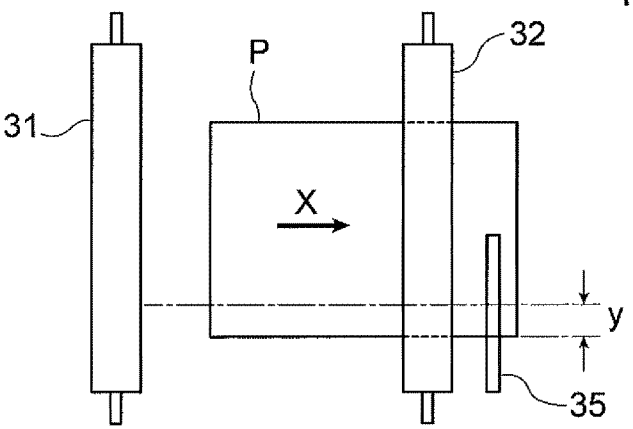

Subsequently, the nip of the pair of upstream side transport rolls 31 is released and the rotation of the pair of registration rolls 32 is started by the driving motor. Accordingly, as shown in FIG. 3C, the sheet P is transported toward the direction of arrow X as the rotation of the pair of registration rolls 32 in the state where the skewing with respect to the transport direction is corrected.

When the sheet P in which skewing has been corrected is transported and the leading edge side of the sheet P in the transport direction reaches the detection sensor 35, the position in the width direction, which is orthogonal to the transport direction, of the sheet P is detected by the detection sensor 35. It should be noted that, in this specific example, the detection sensor 35 detects the position on the leading edge side of the sheet P in the transport direction. The positional information detected by the detection sensor 35 is outputted from the detection sensor 35 to the main controller 14.

Then, in the main controller 14 (refer to FIG. 1), the detected positional information of the sheet P is compared with the position of transfer of the image to be performed by the secondary transfer roll 24 to calculate a deviation amount y of the sheet P from the transfer position.

Figure 3D:
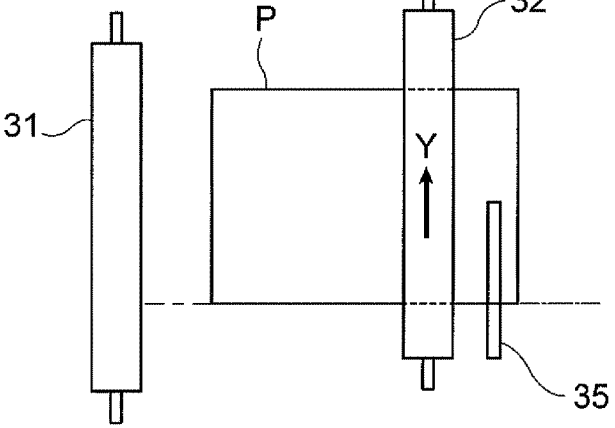

Next, as shown in FIG. 3D, the pair of registration rolls 32 is moved in the direction of arrow Y by the deviation amount y calculated by the main controller 14. Accordingly, the sheet P transported by the pair of registration rolls 32 is also moved in the direction of arrow Y by the deviation amount y, and thereby the position of the sheet P in the direction orthogonal to the transport direction is moved to the correct transfer position on the secondary transfer roll 24.

Subsequently, with regard to the sheet P having been moved to the correct transfer position, the position thereof in the direction orthogonal to the transport direction is detected again.

Thereafter, the sheet P is transported again toward the secondary transfer roll 24 by the pair of registration rolls 32. Then, an image is formed on a predetermined correct position of the sheet P by the secondary transfer roll 24.

Though the details will be described later, in the exemplary embodiment, the positional information of the sheet P detected by the detection sensor 35 in the attitude correction unit 30 is inputted from the main controller 14 to the sheet processing controller 5 in the post-processing device 2. In the post processing performed by the post-processing device 2, the positional information of the sheet P inputted from the main controller 14 to the sheet processing controller 5 is to be used.

<Description of Finisher Unit>

Figure 4:
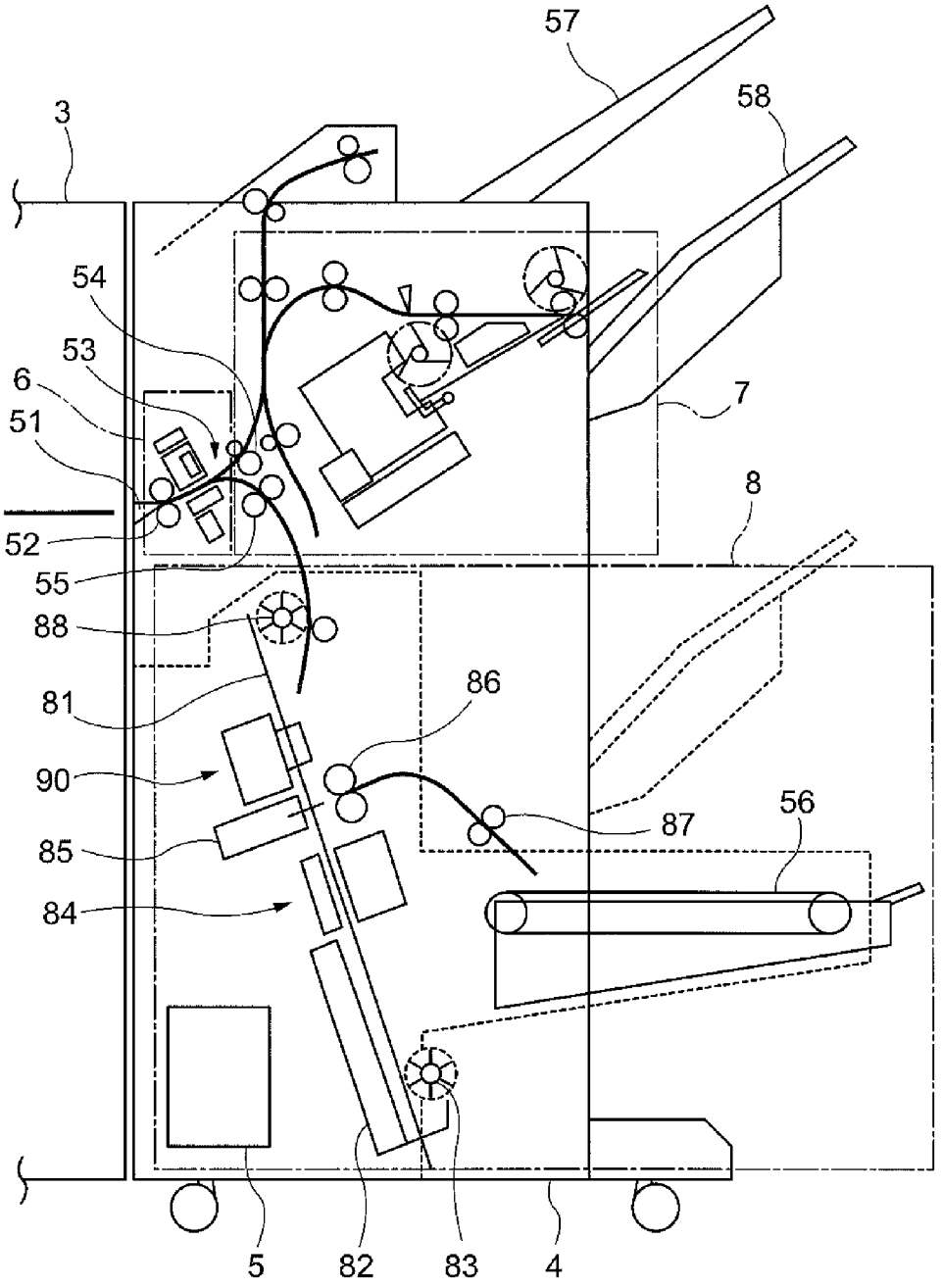
FIG. 4 is a diagram showing a configuration of a finisher unit to which the exemplary embodiment is applied.

Subsequently, description will be given to the finisher unit 4 in the post-processing device 2 of the exemplary embodiment. FIG. 4 is a diagram showing a configuration of the finisher unit 4 to which the exemplary embodiment is applied. As shown in FIG. 4, the finisher unit 4 of the exemplary embodiment includes: a punching functional unit 6 that performs two-hole or four-hole punching on the sheet P; an end-stitching functional unit 7 that generates a bundle of sheets by accumulating a required number of sheets P and performs staple-stitching at an end portion of the bundle of sheets (end-stitching); and a saddle-stitch bookbinding functional unit 8 that generates a bundle of sheets by accumulating a required number of sheets P and performs a stitching process at a center portion of the bundle of sheets (saddle-stitching) to bind up a booklet.

The finisher unit 4 of the exemplary embodiment also includes: a carry-in entrance 51, which is an example of a recording material receiving unit, that receives the sheet P transported from the transport unit 3; entrance rolls 52 that are provided downstream of the carry-in entrance 51 and transport the sheet P received by the carry-in entrance 51 to the punching functional unit 6; a gate 53 that sorts the sheet P passed through the punching functional unit 6; transport rolls 54 and 55 that transport the sheet P or the bundle of sheets having been sorted by the gate 53; and container trays 56 to 58 that contain the sheets P (the bundle of sheets) having been subjected to the post processing.

<Description of Punching Functional Unit>

Figure 5:
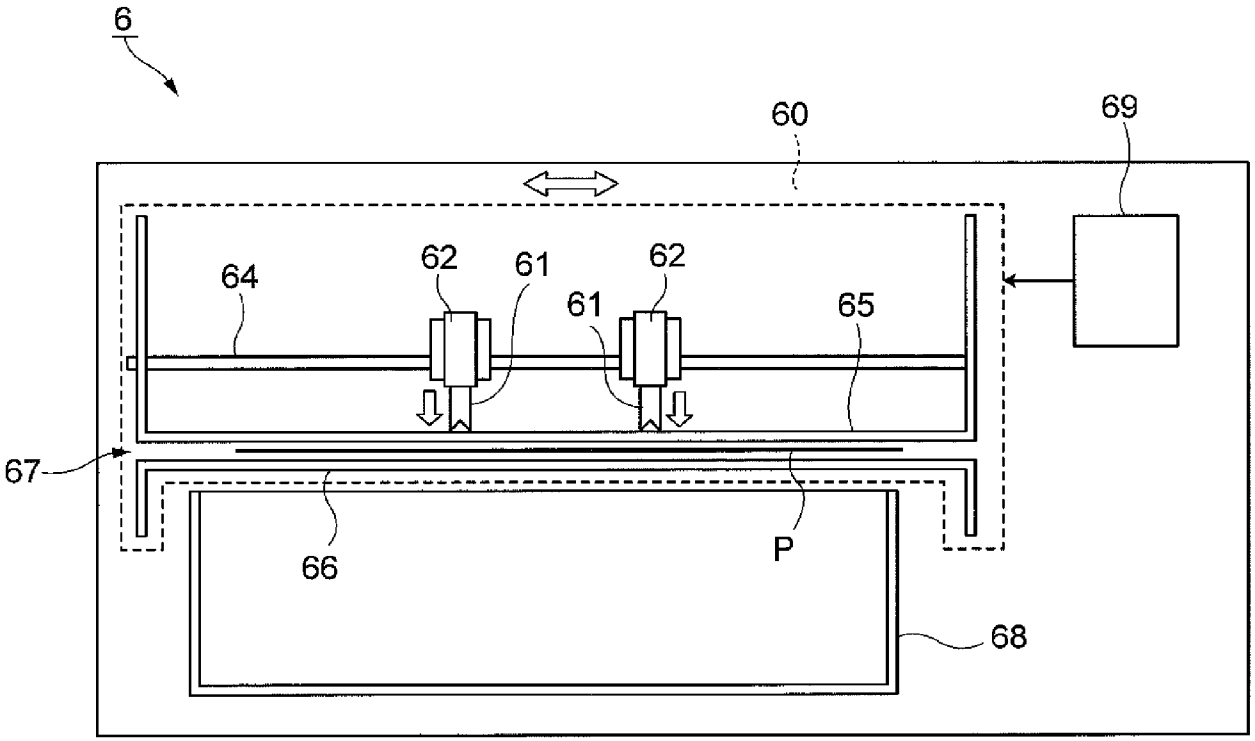
FIG. 5 is a diagram showing a configuration of a punching functional unit of the exemplary embodiment.

Subsequently, description will be given to a configuration of the punching functional unit 6 of the exemplary embodiment. FIG. 5 is a diagram showing a configuration of the punching functional unit 6 of the exemplary embodiment, in which the punching functional unit 6 is viewed from the transport direction of the sheet P. As shown in FIG. 5, the punching functional unit 6 of the exemplary embodiment includes: a punching unit 60, which is an example of a post-processing unit or a punching member, that punches holes in the sheet P; a container member 68 that contains punched chips generated by punching in the punching unit 60; and a punching unit driving motor 69, which is an example of a moving unit, that drives the punching unit 60.

Moreover, as shown in FIG. 5, the punching unit 60 of the exemplary embodiment includes: two punching blades 61 that punch holes in the sheet P; a support member 62 that supports the punching blades 61 and moves the punching blades 61 up and down; a shaft 64 to which the support member 62 is attached; and an upper frame 65 and a lower frame 66 that form a sheet transport path through which the sheet P is transported.

The two punching blades 61 are arranged in line along the direction orthogonal to the transport direction of the sheet P.

The support member 62 is driven by the punching unit driving motor 69 on predetermined timing in accordance with instructions from the sheet processing controller 5 to move the punching blades 61 in the direction vertical to the image forming surface of the sheet P.

The shaft 64 is provided to extend along the direction orthogonal to the transport direction of the sheet P.

The upper frame 65 and the lower frame 66 are provided to face each other, and thereby the sheet transport path 67 through which the sheet P is transported is formed between the upper frame 65 and the lower frame 66. In each of the upper frame 65 and the lower frame 66, at each of regions facing the punching blades 61, a through hole (not shown) having a diameter larger than that of the punching blade 61 is formed. Consequently, in the punching operation, the punching blades 61 are capable of penetrating through the upper frame 65 and the lower frame 66, to thereby move up and down.

Subsequently, description will be given to the punching operation performed in the punching functional unit 6 of the exemplary embodiment. In the punching functional unit 6 of the exemplary embodiment, punching processing is sequentially performed on each of the sheets P sequentially transported from the image forming apparatus 1.

Specifically, in the punching functional unit 6, first, the sheet P carried into the punching functional unit 6 is transported to a predetermined position in the sheet transport path 67 between the upper frame 65 and the lower frame 66 by the entrance rolls 52 (refer to FIG. 4). When the sheet P is transported to the predetermined position, subsequently, the punching blades 61 are moved downwardly toward the sheet P by the support member 62, and are projected toward the sheet P to cut through thereof. Accordingly, two punched holes are formed in the sheet P. The punched chips generated from the sheet P by forming the punched holes are collected in the container member 68 arranged below the punching unit 60.

It should be noted that, after passing through the punching functional unit 6, the sheet P in which the punched holes have been formed by the punching process performed by the punching functional unit 6 is sorted to the saddle-stitch bookbinding functional unit 8 (refer to FIG. 4), the container tray 57 (refer to FIG. 4) or the end-stitching functional unit 7 (refer to FIG. 4) by the gate 53 in accordance with the instructions from the sheet processing controller 5.

Here, the punching unit 60 in the exemplary embodiment is configured to be movable in the direction orthogonal to the transport direction of the sheet P by the punching unit driving motor 69. In the punching functional unit 6 of the exemplary embodiment, based on the positional information of the sheet P obtained from the main controller 4 (refer to FIG. 1) of the image forming apparatus 1 (refer to FIG. 1), the sheet processing controller 5 (refer to FIG. 4) moves the punching unit 60 by the punching unit driving motor 69 in advance of transport of the sheet P to the punching functional unit 6. Consequently, for example, compared to the case where the position of the sheet P is detected in the post-processing device 2 after the sheet P has been transported to the post-processing device 2 (refer to FIG. 1), and thereafter the punching unit 60 is moved, deterioration of productivity in the punching functional unit 6 is suppressed.

It should be noted that detailed description will be given later to movement of the punching unit 60 based on the positional information of the sheet P obtained from the image forming apparatus 1.

<Description of Saddle-Stitch Bookbinding Functional Unit>

Subsequently, description will be given to a configuration of the saddle-stitch bookbinding functional unit 8 of the exemplary embodiment.

As shown in FIG. 4, the saddle-stitch bookbinding functional unit 8 of the exemplary embodiment includes: a compiler tray 81 that compiles a predetermined number of sheets P on which images have been formed; a carry-in roll 88 that carries the sheet P into the compiler tray 81; and an end guide 82 that stacks the sheets P on a positioning stopper projecting on the compiler tray 81 and moves along the compiler tray 81 to determine a saddle-stitching position in the sheets P. The saddle-stitch bookbinding functional unit 8 further includes a sheet aligning paddle 83 that aligns the sheets P compiled on the compiler tray 81 with the end guide 82 and a sheet aligning unit 90 that aligns the sheets P compiled on the compiler tray 81 with the direction orthogonal to the transport direction of the sheet P.

In addition, the saddle-stitch bookbinding functional unit 8 includes: a stapler 84 that performs saddle stitching in the plural sheets P (the bundle of sheets P) compiled on the compiler tray 81; a folder knife 85 that moves from the back surface side of the compiler tray 81 toward the containing surface side thereof to project to face the sheets P (the bundle of sheets) compiled on the compiler tray 81; and folding rolls 86 that are composed of a pair of rolls to nip the sheets P (the bundle of sheets) in which folding thereof has been started by the folder knife 86. The saddle-stitch bookbinding functional unit 8 further includes the container tray 56 that stacks the sheets P (the bundle of sheets) having been subjected to bookbinding by saddle-stitching and folding, and ejecting roll members 87 that eject the sheets P (the bundle of sheets) having been subjected to bookbinding to the container tray 56.

Subsequently, description will be given to saddle-stitch bookbinding functional operation in the saddle-stitch bookbinding functional unit 8.

The sheet P sorted by the gate 53 to the saddle-stitch bookbinding functional unit 8 is forwarded to the carry-in roll 88 via the transport rolls 55.

The carry-in roll 88 sequentially stacks the transported sheets P so that the sheets P are compiled on the compiler tray 81. The sheets of the number, such as five, ten, fifteen and so forth, set by the main controller 14 (refer to FIG. 1) in the image forming apparatus 1 (refer to FIG. 1) are compiled on the compiler tray 81. At this time, the end guide 82 has moved and stopped so that the center portion of the sheets P in the sheet transport direction coincides with the position of stapling by the stapler 84. On that occasion, further, the sheet aligning unit 90 performs sheet alignment of the sheets P compiled on the compiler tray 81 in the width direction (the direction orthogonal to the transport direction of the sheet P). It should be noted that description will be given later to a configuration of the sheet aligning unit 90 and alignment process for the sheets P by the sheet aligning unit 90.

After the predetermined number of sheets P (the bundle of sheets) are compiled on the compiler tray 81, saddle stitching in a part of the bundle of sheets (for example, the center part of the bundle of sheets) is performed by the stapler 84. Next, the bundle of sheets subjected to the saddle-stitching process is moved so that the folding portion thereof (for example, the center part of the bundle of sheets) coincides with the tip end position of the folder knife 85 by upward movement of the end guide 82. After the folding position of the bundle of sheets moves to the tip end position of the folder knife 85, the folder knife 85 is pushed from the back surface side toward the containing surface side of the compiler tray 81. This brings the tip end of the folder knife 85 into contact with the bundle of sheets. Then, the tip end of the folder knife 85 is further pushed upwardly, and thereby the bundle of sheets is lifted and nipped between the folding rolls 86. In this manner, the folding process by the folder knife 85 and the folding rolls 86 is applied to the bundle of sheets. It should be noted that the folder knife 85 is configured to move to a position so that the bundle of sheets sufficiently enters between the folding rolls 86, and is configured so that the tip end thereof is retracted to the back surface side of the compiler tray 81 during the step of compiling the sheets on the compiler tray 81, the step of saddle stitching by the stapler 84 and the step of transporting the sheets after saddle stitching so as not to appear on the containing surface of the compiler tray 81.

Thereafter, the sheets P (the bundle of sheets) in which the folding process by the folding rolls 86 is completed are transported by the transport roll member 87, and stacked on the container tray 56.

<Description of Sheet Aligning Unit>

Subsequently, a configuration of the sheet aligning unit 90 of the exemplary embodiment will be described.

Figure 6A:
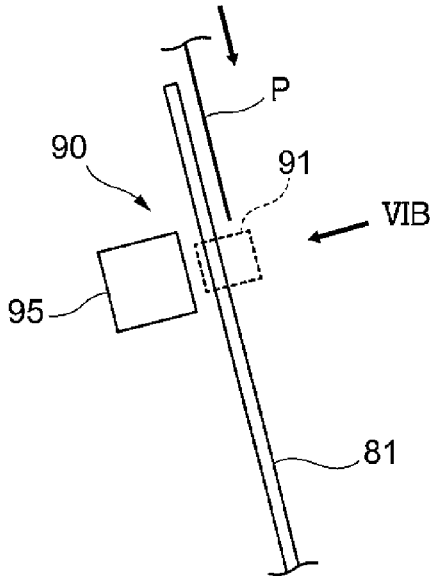
FIGS. 6A to 6C are diagrams illustrating a sheet aligning unit of the exemplary embodiment.
Figure 6C:
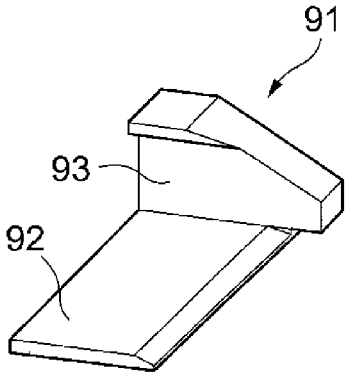
Figure 6B:
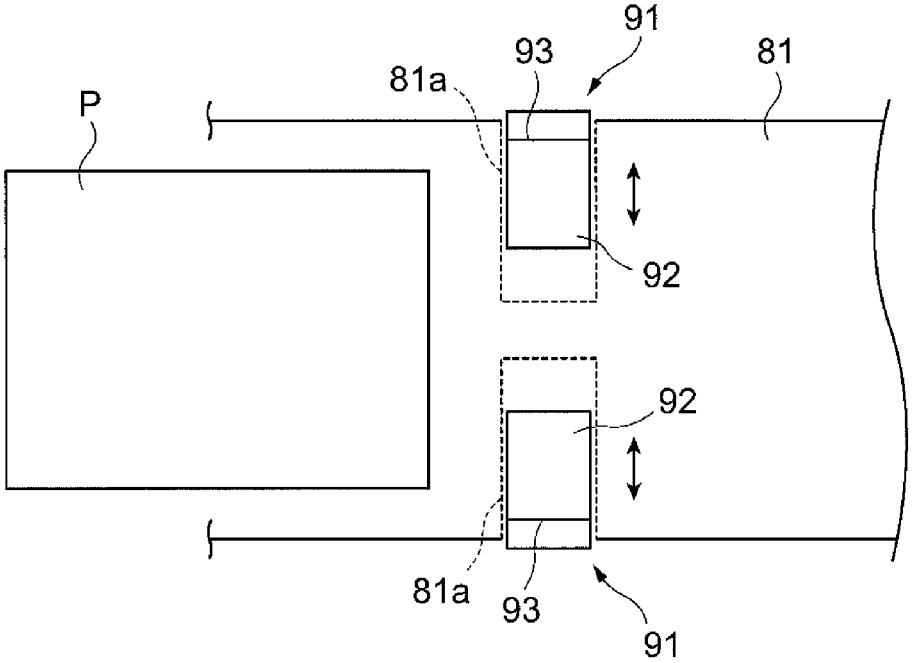

FIGS. 6A to 6C are diagrams illustrating the sheet aligning unit 90 of the exemplary embodiment. FIG. 6A is a diagram showing the configuration of the sheet aligning unit 90, FIG. 68 is a diagram viewing the FIG. 6A from the direction of arrow VIB. It should be noted that, in FIGS. 6A and 6B, illustration of the end guide 82, the stapler 84, the folder knife 85, the folding rolls 86 and so forth is omitted.

As shown in FIG. 6A, the sheet aligning unit 90 of the exemplary embodiment includes a damper 91, which is an example of the post-processing unit or a position adjusting member, that contacts the sheet P placed on the compiler tray 81 to align the sheets P in the direction orthogonal to the transport direction, and a damper driving motor 95, which is an example of the moving unit, that drives the damper 91 to slide in the direction orthogonal to the transport direction of the sheet P. As shown in FIG. 6B, the damper 91 is provided to each of both end portion sides in the width direction of the compiler tray 81.

FIG. 6C is a diagram for illustrating the shape of the damper 91. As shown in FIG. 6C, the damper 91 of the exemplary embodiment is formed in an L shape and includes a sliding plate portion 92 provided on the surface of the compiler tray 81 in almost parallel therewith and a standing plate portion 93 that is provided on an outer end portion of the sliding plate portion 92 in the direction orthogonal to the sheet transport direction and vertically extends from the sliding plate portion 92. It should be noted that the two dampers 91 are formed and arranged to have a symmetric shape.

Moreover, as shown in FIG. 6B, cutout portions 81a are provided in the compiler tray 81 by forming cutouts extending along the direction orthogonal to the transport direction of the sheet P at the positions where the two dampers 91 are provided.

The two dampers 91 move in a reciprocating motion in the direction of mutually separating and approaching along the cutout portions 81a of the compiler tray 81 upon being driven by the damper driving motor 95.

Subsequently, description will be given to the operation of aligning the sheets P performed in the sheet aligning unit 90 of the exemplary embodiment.

When the sheet P is carried into the predetermined position in the compiler tray 81, the two dampers 91 are driven by the damper driving motor 95 and are moved so as to approach the sheet P from both end portion sides in the width direction of the sheet P along the width direction of the sheet P. Then, the dampers 91 push the sheet P in the width direction by contacting both end portions in the width direction of the sheet P with the standing plate portion 93. Consequently, the sheet P is moved in the direction orthogonal to the transport direction. Thereafter, by repeating the reciprocating movement of the dampers 91 along the width direction of the sheet P, the sheets P are moved along the width direction, and thereby the positions of the sheets P along the width direction are aligned with the predetermined position.

In the sheet aligning unit 90 of the exemplary embodiment, prior to carrying the sheet P into the compiler tray 81, based on the positional information of the sheet P obtained from the main controller 4 of the image forming apparatus 1, the sheet processing controller 5 moves the dampers 91 in advance so as to approach the position where the sheet P is carried in. Accordingly, for example, compared to the case where the position of the sheet P is detected in the post-processing device 2 and the dampers 91 are moved after the sheet P has been transported to the compiler tray 81, it becomes possible to reduce the time required to align the position of the sheet P in the sheet aligning unit 90, and thereby deterioration of productivity in the saddle-stitch bookbinding functional unit 8 is suppressed.

<Description of Movement of Punching Unit and Dampers based on Positional Information of Sheet>

Subsequently, description will be given to a configuration to move the punching unit 60 and the dampers 91 in advance in the finisher unit 4 of the post-processing device 2 based on the positional information of the sheet P detected in the image forming apparatus 1.

Figure 7:
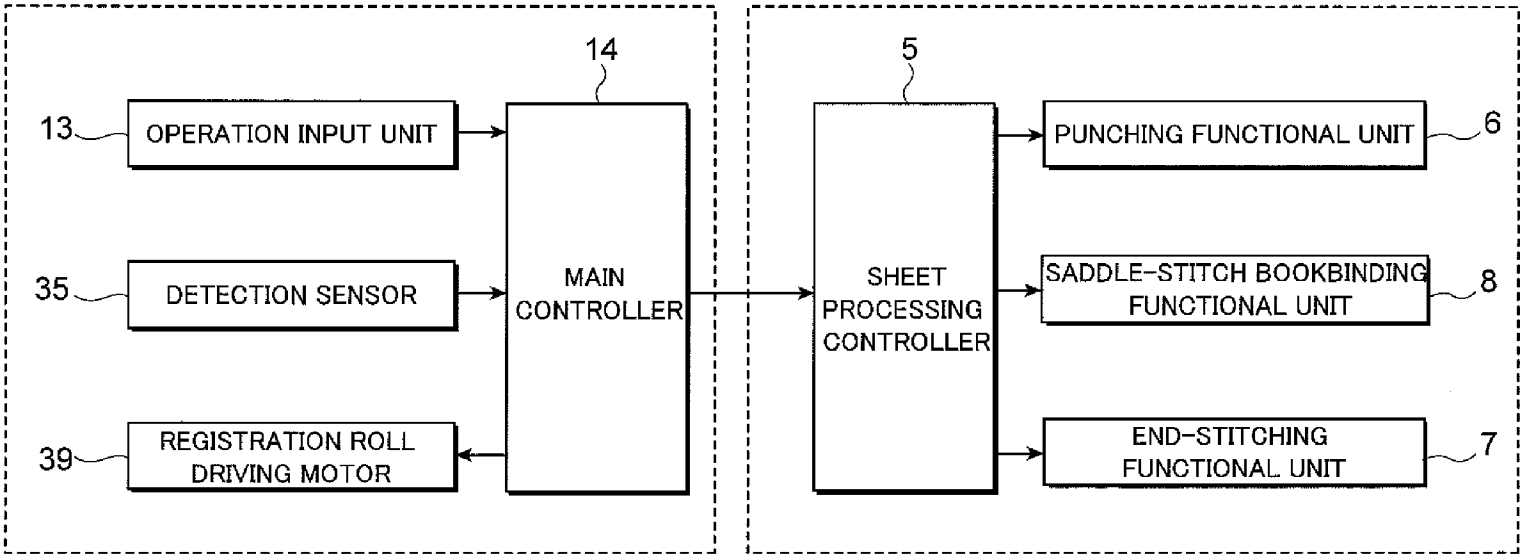
FIG. 7 is a control block diagram of the image forming system shown in FIG. 1.

FIG. 7 is a control block diagram of the image forming system 100 shown in FIG. 1. FIGS. 8A1 to 8A4 and 8B1 to 8B4 are diagrams for illustrating movement of the punching unit 60 and the dampers 91 in accordance with positional information of the sheet P. FIGS. 8A1 to 8A4 show the movement of the punching unit 60, and FIGS. 8B 1 to 8B4 show the movement of the dampers 91.

In the image forming system 100 of the exemplary embodiment, as shown in FIG. 7, information related to the post processing to be performed on the sheet P is outputted from the main controller 14 provided in the image forming apparatus 1 to the sheet processing controller 5 in the post-processing device 2, and based on the information, the sheet processing controller 5 controls each mechanism provided in the post-processing device 2. Examples of the information related to the post processing to be performed on the sheet P include the kinds of post processing to be performed on the sheet P (the punching process, the saddle-stitch bookbinding process, the end-stitching process and so on), the position where the post processing is performed on the sheet P, and so forth.

In the image forming apparatus 1, information related to the post processing to be performed on the sheet P, which has been received via the operation input unit 13, is inputted to the main controller 14. Further, in the image forming apparatus 1, the positional information of the sheet P in the direction orthogonal to the transport direction of the sheet P (the width direction) detected by the detection sensor 35 of the attitude correction unit 30 is inputted to the main controller 14. Here, in the attitude correction unit 30 of the exemplary embodiment, based on the positional information of the sheet P detected by the detection sensor 35, the pair of registration rolls 32 is moved by the registration roll driving motor 39. In the case where the positional information of the sheet P is detected again by the detection sensor 35 after the pair of registration rolls 32 is moved, the positional information of the sheet P detected after the pair of registration rolls 32 is moved is also inputted to the main controller 14.

Then, the main controller 14 outputs the information related to the post processing to be performed on the sheet P, which has been received via the operation input unit 13, and the positional information of the sheet P detected by the detection sensor 35 (including the positional information of the sheet P that is detected again) to the sheet processing controller 5 in the post-processing device 2.

Moreover, in the sheet processing controller 5 of the post-processing device 2, the information related to the post processing to be performed on the sheet P and the positional information of the sheet P are inputted from the main controller 14 of the image forming apparatus 1. Then, in the post-processing device 2, based on the information related to the post processing to be performed on the sheet P and the positional information of the sheet P inputted to the sheet processing controller 5, operations of the punching functional unit 6, the saddle-stitch bookbinding functional unit 8 and the end-stitching functional unit 7 provided in the finisher unit 4 of the post-processing device 2 are controlled.

Here, description will be given to the advance movement of the punching unit 60 in the punching functional unit 6 based on the positional information of the sheet P inputted to the sheet processing controller 5.

In the punching functional unit 6, when the sheet processing controller 5 has not obtained the positional information of the sheet P, which is an object of the saddle-stitch bookbinding process, or in the case where the punching process is not performed on the sheet P, the punching unit 60 is on standby at the predetermined stand-by position as shown in FIG. 8A1. It should be noted that the stand-by position of the punching unit 60 may be, for example, the center portion in the sheet transport path 67 in the direction orthogonal to the transport direction of the sheet P.

Subsequently, when image formation on the sheet P is started in the image forming apparatus 1 (refer to FIG. 1) and the sheet P, which is an object of the image formation, is transported to the attitude correction unit 30 (refer to FIG. 1), the positional information of the sheet P related to the direction orthogonal to the transport direction thereof is detected by the detection sensor 35 (refer to FIG. 3). The positional information of the sheet P detected by the detection sensor 35 is inputted from the main controller 14 of the image forming apparatus 1 to the sheet processing controller 5 of the post-processing device 2. From the inputted positional information of the sheet P, the sheet processing controller 5 calculates a planned transport position Q1 in the punching functional unit 6 where the sheet P is to be transported.

Then, as shown in FIG. 8A2, the sheet processing controller 5 moves the punching unit 60 to the calculated planned transport position Q1 before the leading edge portion of the sheet P in the transport direction reaches the sheet transport path 67 in the punching functional unit 6. In other words, the sheet processing controller 5 moves the punching unit 60 so that the punching process is to be performed at the predetermined position on the sheet P when the sheet P is transported to the planned transport position Q1.

After the punching unit 60 is moved to the planned transport position Q1, the sheet P on which an image has been formed in the image forming apparatus 1 is transported to the sheet transport path 67 of the punching functional unit 6. Here, normally, as shown in FIG. 8A3, the sheet P is transported toward the planned transport position Q1 calculated by the sheet processing controller 5.

Then, as shown in FIG. 8A4, when the sheet P is transported to the planned transport position Q1, the punching process is performed on the sheet P by the punching unit 60.

Here, in the punching functional unit 6 of the exemplary embodiment, as shown in FIG. 8A2, the punching unit 60 is moved in advance to the planned transport position Q1 of the sheet P before the leading edge portion of the sheet P in the transport direction, which is the object of the punching process, reaches the punching functional unit 6. Accordingly, the necessity to move the punching unit 60 after the sheet P is transported to the punching functional unit 6 is small. In other words, in the punching functional unit 6 of the exemplary embodiment, there is no need to provide a standby time for causing the sheet P to be on standby for moving the punching unit 60 before applying the punching process to the sheet P.

Consequently, as compared with a case where the present configuration is not employed, it becomes possible to reduce the time required for performing the punching process on the sheet P in the punching functional unit 6, and therefore, it becomes possible to suppress deterioration of productivity in the punching functional unit 6.

Especially, as in the punching functional unit 6 of the exemplary embodiment, in the case where the punching process is sequentially performed on each of the plural sheets P that are sequentially transported from the image forming apparatus 1, by sequentially moving the punching unit 60 before each sheet reaches the punching functional unit 6, it is possible to further suppress deterioration of productivity in the punching functional unit 6 as compared with a case where the present configuration is not employed.

Next, description will be given to the advance movement of the dampers 91 in the sheet aligning unit 90 of the saddle-stitch bookbinding functional unit 8 based on the positional information of the sheet P inputted to the sheet processing controller 5.

In the sheet aligning unit 90 of the saddle-stitch bookbinding functional unit 8, when the sheet processing controller 5 has not obtained the positional information of the sheet P, which is an object of the saddle-stitch bookbinding process, or in the case where the saddle-stitch bookbinding process is not performed on the sheet P, the dampers 91 are on standby at the predetermined stand-by position as shown in FIG. 8B1. It should be noted that the stand-by position of the dampers 91 may be, for example, both end portions of the compiler tray 81 in the width direction.

Subsequently, when image formation on the sheet P is started in the image forming apparatus 1 (refer to FIG. 1) and the sheet P, which is an object of the image formation, is transported to the attitude correction unit 30 (refer to FIG. 1), the positional information of the sheet P related to the direction orthogonal to the transport direction thereof is detected by the detection sensor 35 (refer to FIG. 3). The positional information of the sheet P detected by the detection sensor 35 is inputted from the main controller 14 of the image forming apparatus 1 to the sheet processing controller 5 of the post-processing device 2. From the inputted positional information of the sheet P, the sheet processing controller 5 calculates a planned transport position Q2 in the compiler tray 81 where the sheet P is to be transported.

Then, as shown in FIG. 8B2, the sheet processing controller 5 moves the dampers 91 to the calculated planned transport position Q2 before the leading edge portion of the sheet P in the transport direction reaches the compiler tray 81 in the saddle-stitch bookbinding functional unit 8.

In other words, the sheet processing controller 5 moves the dampers 91 at a position separated from the sheet P by a predetermined distance when the sheet P is transported to the planned transport position Q2.

After the dampers 91 are moved to the planned transport position Q2, the sheet P on which an image has been formed in the image forming apparatus 1 is transported to the compiler tray 81 of the saddle-stitch bookbinding functional unit 8. Here, normally, as shown in FIG. 8B3, the sheet P is transported toward the planned transport position Q2 calculated by the sheet processing controller 5.

Then, as shown in FIG. 8B4, when the sheet P is transported to the planned transport position Q2 in the compiler tray 81, the sheet aligning process is performed on the sheet P by the dampers 91.

Here, in the saddle-stitch bookbinding functional unit 8 of the exemplary embodiment, as shown in FIG. 8B2, the dampers 91 are moved in advance to the planned transport position Q2 of the sheet P before the leading edge portion of the sheet P in the transport direction, which is the object of the sheet aligning process, reaches the compiler tray 81. Accordingly, the necessity to move the dampers 91 after the sheet P is transported to the compiler tray 81 is small. In other words, in the sheet aligning unit 90 of the exemplary embodiment, there is no need to provide a standby time for causing the sheet P to be on standby for moving the dampers 91 before applying the sheet aligning process to the sheet P.

Consequently, as compared with a case where the present configuration is not employed, it becomes possible to reduce the time required for performing the sheet aligning process on the sheet P in the saddle-stitch bookbinding functional unit 8, and therefore, it becomes possible to suppress deterioration of productivity in the saddle-stitch bookbinding functional unit 8.

Moreover, as in the exemplary embodiment, by moving the dampers 91 in advance to the planned transport position Q2 of the sheet P, it becomes possible to suitably locate the dampers 91 for each of the sheets P that are sequentially transported. This enables to perform the sheet aligning process on the sheet P more favorably as compared with a case where the present configuration is not employed.

As described above, in the image forming system 100 (refer to FIG. 1) of the exemplary embodiment, the sheet processing controller 5 in the post-processing device 2 obtains the positional information of the sheet P detected by the detection sensor 35 provided in the image forming apparatus 1 (refer to FIG. 1), and based on the obtained positional information of the sheet P, the punching unit 60 or the dampers 91 are moved in advance of transport of the sheet P. With such a configuration, in the post-processing device 2 of the exemplary embodiment, there is no need to provide the standby time for causing the sheet P to be on standby for moving the punching unit 60 or the dampers 91 after the sheet P is transported to the post-processing device 2. Accordingly, as compared with a case where, for example, the positional information of the sheet P is detected after the sheet P is transported to the post-processing device 2 and the punching unit 60 or the dampers 91 are moved in the state where the sheet P is on standby, and thereafter, the process is performed on the sheet P, it becomes possible to suppress deterioration of productivity in the post-processing device 2.

In addition, with the above-described configuration, in the image forming system 100 of the exemplary embodiment, the position of the sheet P in the width direction thereof is detected by the detection sensor 35 provided in the image forming apparatus 1. Accordingly, in the image forming system 100 of the exemplary embodiment, a sensor for detecting the position of the sheet P in the width direction is unnecessary in the post-processing device 2. Accordingly, by employing the present configuration, it becomes possible to simplify the configuration of the post-processing device 2 as compared with a case where the sensor for detecting the position of the sheet P in the width direction is provided in both of the image forming apparatus 1 and the post-processing device 2 in the image forming system 100.

It should be noted that, the exemplary embodiment has a configuration in which the sheet processing controller 5 obtains the positional information of the sheet P detected by the detection sensor 35 of the image forming apparatus 1, and based on the obtained positional information of the sheet P, the punching unit 60 or the like is moved; however, for example, the configuration may be such that a sensor (not shown) for detecting the positional information of the sheet P is also provided in the post-processing device 2, and the punching unit 60 or the like is moved based on the positional information of the sheet P detected by both of the detection sensor 35 provided in the image forming apparatus 1 and the sensor provided in the post-processing device 2. Specifically, the configuration may be such that the punching unit 60 or the like is moved in advance based on the positional information of the sheet P detected by the detection sensor 35 in the image forming apparatus 1 before the sheet P is transported to the post-processing device 2, and thereafter, when the sheet P is transported to the post-processing device 2, the positional information of the sheet P is detected again in the post-processing device 2, and thereby the position of the punching unit 60 moved in advance is finely adjusted based on the detected positional information of the sheet P. In this way, by employing the configuration in which the position of the sheet P is detected not only in the image forming apparatus 1, but also in the post-processing device 2, it becomes possible to move the punching unit 60 or the like to the most suitable position so that the process is performed on the sheet P at the predetermined position.

In this specific example, the punching unit 60 is moved in advance based on the positional information of the sheet P detected in the image forming apparatus 1. Accordingly, even in the case where the punching unit 60 or the like is moved again based on the positional information of the sheet P detected in the post-processing device 2, the moving amount of the punching unit 60 or the like is able to be reduced as compared with a case where the punching unit 60 is not moved in advance.

Consequently, compared to the case where the present configuration is not employed, the time related to the movement of the punching unit 60 or the like is reduced, to thereby enable to suppress deterioration of productivity in the post-processing device 2.

Moreover, in the exemplary embodiment, the configuration is employed in which the main controller 14 outputs the positional information of the sheet P detected by the detection sensor 35 in the image forming apparatus I to the sheet processing controller 5, then, based on the positional information of the sheet P, the sheet processing controller 5 controls the punching unit driving motor 69 or the damper driving motor 95 to move the punching unit 60 or the dampers 91. However, for example, the main controller 14 in the image forming apparatus 1 may also have the function of the sheet processing controller 5. Specifically, the configuration may be such that, based on the positional information of the sheet P detected by the detection sensor 35, the main controller 14 controls the punching unit driving motor 69 or the damper driving motor 95 to move the punching unit 60 or the dampers 91.

Further, in the exemplary embodiment, the configuration is employed in which, in the finisher unit 4 of the post-processing device 2, the sheet processing controller 5 moves the punching unit 60 or the dampers 91 based on the positional information of the sheet P obtained from the main controller 14 in the image forming apparatus 1. However, in the post-processing device 2, an object moved by the sheet processing controller 5 based on the obtained positional information of the sheet P is not limited to these units. For example, the configuration may be such that, based on the obtained positional information of the sheet P, the sheet processing controller 5 moves a binding unit (not shown) that performs a binding process on the sheets P (the bundle of sheets) or transport rolls (not shown) that transport the sheet P in the post-processing device 2.

Still further, the image forming apparatus 1 of the exemplary embodiment detects the position of the sheet P in the width direction by the detection sensor 35 in the attitude correction unit 30, and thereafter, moves the sheet P in the width direction by the pair of registration rolls 32 to cause the sheet P to coincide with the transfer position. However, the image forming apparatus 1 does not necessarily have a configuration to move the sheet P in the width direction in the attitude correction unit 30. For example, a configuration is available in which, after the positional information of the sheet P is detected by the detection sensor 35 in the attitude correction unit 30, the sheet P is transported toward the secondary transfer roll 24 without moving in the width direction, and then the image is transferred by the secondary transfer roll 24 based on the positional information of the sheet P detected by the detection sensor 35.

In this case, the main controller 14 outputs the positional information of the sheet P, which has been detected by the detection sensor 35 prior to transporting to the secondary transfer roll 24, to the sheet processing controller 5.

Moreover, the main controller 14 outputs the positional information of the sheet P detected by the detection sensor 35 to the sheet processing controller 5; however, the configuration thereof may be such that, for example, a moving amount of the pair of registration rolls 32 or the like calculated based on the detected positional information of the sheet P is outputted to the sheet processing controller 5.

In this case, in the post-processing device 2, for example, the above-described planned transport position Q1 (or Q2) of the sheet P is calculated based on the moving amount of the pair of registration rolls 32 inputted from the main controller 14 to the sheet processing controller 5, to thereby perform the post processing on the sheet P.

In addition, in the exemplary embodiment, in the image forming apparatus 1, the position of the sheet P orthogonal to the transport direction is detected by the detection sensor 35 provided in the attitude correction unit 30 that corrects the attitude of the sheet P before being transported to the secondary transfer roll 24; however, the location for detecting the position of the sheet P in the image forming apparatus 1 is not limited thereto. For example, a detection sensor (not shown) may be provided on the upstream side of the fixing device 25 in the sheet transport direction, to thereby detect the position of the sheet P.

Moreover, in the image forming apparatus 1 of the exemplary embodiment, the detection sensor 35 detects the position of the sheet P on the leading edge side in the transport direction; however, the position of the sheet P to be detected by the detection sensor 35 is not limited thereto, and for example, the position of the sheet P on the trailing edge side in the transport direction may be detected.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material post-processing device comprising:

a recording material receiving unit that receives a recording material on which an image is formed from an image forming apparatus, the image forming apparatus comprising:

an image forming unit that forms an image on a recording material to be transported, and a detection unit that detects a position of the recording material, on which the image is to be formed by the image forming unit, in a direction intersecting a transport direction of the recording material, wherein the detection unit detects the position of the recording material before the image forming unit forms the image on the recording material;

a position adjusting member that adjusts the position of the recording material in the direction intersecting the transport direction of the recording material, the recording material being received via the recording material receiving unit from the image forming apparatus;

a moving unit that moves the position adjusting member in the direction intersecting the transport direction of the recording material based on information related to the position of the recording material detected by the detection unit of the image forming apparatus; and a binding unit that performs a binding process on the recording material, the position of which has been adjusted by the position adjusting member moved by the moving unit.

2. The recording material post-processing device according to claim 1, wherein, based on the information related to the position of the recording material detected by the detection unit of the image forming apparatus, the moving unit moves the position adjusting member in the direction intersecting the transport direction of the recording material before a leading edge portion of the recording material in the transport direction reaches the position adjusting member.

3. An image forming system comprising:

an image forming apparatus that forms an image on a recording material; and a post-processing device that performs post processing on the recording material on which the image is formed by the image forming apparatus, wherein the image forming apparatus includes:

an image forming unit that forms an image on a recording material to be transported; and a detection unit that detects a position of the recording material, on which the image is to be formed by the image forming unit, in a direction intersecting a transport direction of the recording material, wherein the detection unit detects the position of the recording material before the image forming unit forms the image on the recording material, and the post-processing device includes:

a position adjusting member that adjusts the position of the recording material in the direction intersecting the transport direction of the recording material, the recording material transported from the image forming apparatus;

a moving unit that moves the post-processing unit in the direction intersecting the transport direction of the recording material based on information related to the position of the recording material detected by the detection unit of the image forming apparatus; and a binding unit that performs a binding process on the recording material, the position of which has been adjusted by the position adjusting member moved by the moving unit.

4. The image forming system according to claim 3, wherein the image forming apparatus further includes a correction unit that corrects a position of the recording material according to a position where the image is formed by the image forming unit, and the detection unit of the image forming apparatus detects the position of the recording material after the position is corrected by the correction unit.

* * * * *